United States Patent [19]

Sigle

[11] Patent Number: 5,056,793

[45] Date of Patent: Oct. 15, 1991

[54] PICTURE IDENTIFICATION GAME

[76] Inventor: Harold A. Sigle, 5731 SW. 69th, Auburn, Kans. 66402

[21] Appl. No.: 531,528

[22] Filed: Jun. 1, 1990

[51] Int. Cl.[5] ..... A63F 3/00

[52] U.S. Cl. ..... 273/282; 434/348

[58] Field of Search ..... 273/1 R, 273, 282, 157 A, 273/240; 434/348; 40/594, 595

[56] References Cited

U.S. PATENT DOCUMENTS

| | | | |
|---|---|---|---|
| 1,359,115 | 11/1920 | Sittinger . | |
| 1,375,308 | 4/1921 | Mathes | 434/348 |
| 2,481,109 | 9/1949 | Grace . | |
| 3,097,435 | 7/1963 | Goldschmidt | 434/348 |
| 3,110,499 | 11/1963 | Boeskool | 434/348 X |
| 3,460,836 | 8/1969 | Schwartz | 273/282 R X |
| 3,466,217 | 9/1969 | Mott | 40/594 X |
| 3,503,835 | 3/1970 | Herrmann | 40/594 X |
| 3,593,434 | 7/1971 | McGarry . | |
| 3,849,913 | 11/1974 | Williams | 40/594 X |
| 3,854,726 | 12/1974 | Balder . | |
| 3,937,472 | 2/1976 | Rice . | |
| 3,939,588 | 2/1976 | Hockaday | 40/594 X |
| 3,949,935 | 4/1976 | Stackig | 40/594 X |
| 4,544,360 | 10/1985 | Goodman | 434/348 X |
| 4,756,533 | 7/1988 | Hopkins et al. . | |
| 4,767,119 | 8/1988 | Fadner et al. | 40/594 X |

FOREIGN PATENT DOCUMENTS 452479 5/1968 Switzerland .

*Primary Examiner*—Edward M. Coven
*Assistant Examiner*—William E. Stoll
*Attorney, Agent, or Firm*—Litman, McMahon & Brown

[57] ABSTRACT

A picture identification game apparatus for competitive determination of the identity of the subject matter of a partially exposed picture, such as a photograph or drawing of a well-known person, thing, or member of a select group. The picture is initially concealed with cover pieces of opaque material removably secured in an adjacent relationship to a protective window superimposed in front of the picture. Each of the pieces is uniquely identified by a marking on the exposed surface thereof. The covered picture is then displayed or published to the members of a group of competing participants. By a process which is keyed to the identifying marks, a first one of the opaque pieces is randomly selected and removed, thereby exposing a small portion of the concealed picture. After a predetermined period of time, a second piece is randomly selected and removed, thereby revealing another small portion of the concealed picture. The procedure is continued until one of the competing participants wins by correctly identifying the subject matter portrayed by the picture.

5 Claims, 1 Drawing Sheet

PICTURE IDENTIFICATION GAME

FIELD OF THE INVENTION

The present invention relates to a game for a group of participants each of which is competitively attempting to be the first to identify the subject matter of a partially concealed picture as additional portions of the picture are randomly and sequentially exposed to the participants.

BACKGROUND OF THE INVENTION

The curiosities of the various members of our society are constantly driven to seek challenges whereby our wits, knowledge and skills can be pitted against other individuals in a competitive environment. These circumstances arise in a variety of situations, such as for amusement, to generate greater discourse among strangers having a common interest, to focus attention on a particular product or service for marketing and promotion purposes, or for a variety of other applications.

For example, riddles, trivia quizzes, and word games have been commonly used by radio and television broadcasters as well as newspaper and magazine publishers to accomplish one or more of these objectives. Many times these applications are presented in a serial manner with additional hints provided sequentially to entice and induce greater interest as individuals repeatedly return to the same media to participate in and to remain cognizant of the progressive development toward an ultimate solution and conclusion.

The obvious interest is spiked by the desire or fantasy of each participant to be the lucky recipient of the promised benefit, which may be nothing more than the realization that he or she won. Other benefactors of this arrangement include the sponsor of the activity, who may enhance the promotion of a particular product or service, and the media provider, who may realize more comprehensive circulation and distribution of his proffered services.

Another very important and not to be overlooked aspect of such an application is the opportunity to enhance our social environment by providing a common point of interest for discourse among members of society. For example, a group of strangers thrust upon each other could many times use a moderately involved activity to serve as an "icebreaker" to encourage development of discussions and familiarity therebetween.

SUMMARY OF THE INVENTION

A picture identification game apparatus is provided to challenge individual participants to be the first to identify a visual depiction of a person, place or thing which depiction is initially concealed behind opaque cover pieces removably secured by a pressure-sensitive adhesive to a transparent overlay superimposed in front of and abutting against the visual depiction. Each of the cover pieces is uniquely identified by a marking on an exposed surface thereof.

Based upon a random selection process associated with the markings on the opaque cover pieces, one of the pieces is selected and removed, exposing a small portion of the underlying depiction. After a predetermined time interval, which may be a few minutes or several days depending on the particular application of the game, a second piece is randomly selected and removed, exposing another small portion of the underlying depiction.

The procedure is continued until sufficient detail is revealed whereby one of the participants recognizes and correctly identifies the subject matter portrayed by the depiction, thereby winning the game.

OBJECTS OF THE INVENTION

Therefore, the objects of the present invention are: to provide a game apparatus and a method to sequentially expose relatively small, randomly selected portions of a depiction; to provide such a game apparatus and a method which can be used to develop a spirit of competition among participants of a selected group; to provide such a game apparatus and a method which can be used to foster greater familiarity among members of a selected group; to provide such a game apparatus and a method which can be used to directly or indirectly promote a particular product or service; to provide such a game apparatus and a method which can be used to focus attention on a particular communication medium; to provide such a game apparatus and a method which is entertaining; to provide such a game apparatus and a method which is simple to understand, easy to use, inexpensive to produce, and which generally performs the requirements of its intended purposes.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
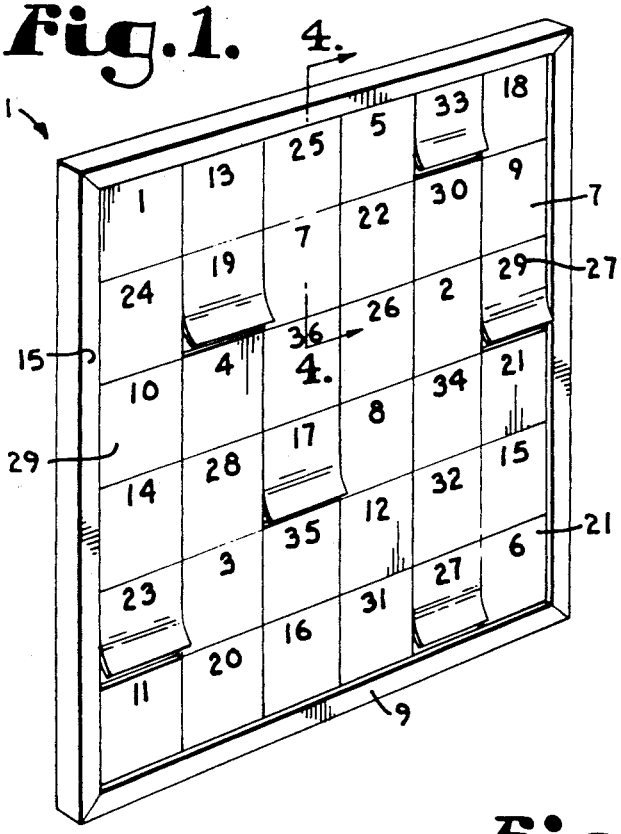
FIG. 1 is a perspective view of a picture identification game apparatus with a plurality of cover pieces in accordance with the present invention.
Figure 4:
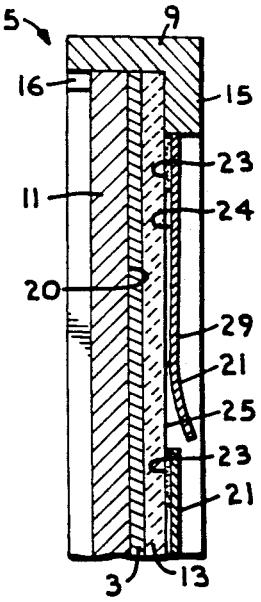
FIG. 4 is an enlarged and fragmentary cross-sectional view taken along line 4—4 of the picture identification game apparatus in accordance with the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a picture identification game apparatus in accordance with the present invention. The game 1 comprises a depiction or picture 3, a means for displaying the picture 3 such as a frame assembly 5, and a mask 7.

The picture 3 comprises a planar photograph, drawing, print, or the like, and portrays a celebrity, famous person, member of a select group of persons, place, thing, or the like, which can generally be readily recognized and identified by viewers thereof.

The frame assembly 5 comprises a frame 9, a backing board 11, and a viewing window 13. The frame 9 is generally rectangularly shaped and is adapted to contain the backing board 11, the picture 3, and the viewing window 13 in side-by-side abutting relationship.

The frame 9 has a first lip 15 and a second lip or stop 16 which restrains the viewing window 13 and the backing board 11 therein with the picture 3 sandwiched therebetween. The frame 9 has a slot (not shown) whereby the viewing window 13 is slidably removable, such as that indicated by the arrow referenced by the numeral 17 and the phantom lines referenced by the numeral 19 in FIG. 3. After removing the viewing window 13 from the frame 9, the picture 3 is similarly removable from the frame 9 through such slot. Then, another picture 3 is insertable therethrough, with the viewing window 13 reinsertable between the picture 3 and the lip 15 of the frame 9 to complete the installation of a different picture 3 therein.

The backing board 11 is constructed of rigid material, such as corrugated cardboard or the like, which is capable of supporting itself while standing on edge in the frame 9. A side 20 of the backing board 11, which abuts against the picture 3, is substantially planar. The viewing window 13 is constructed of rigid transparent material, such as glass, plastic, or other suitable material, which is capable of supporting itself while standing on edge. Preferably, the viewing window 13 has two substantially parallel planar surfaces such that an observer facing the game 1 can clearly distinguish the features and details of the picture 3 therebehind.

The mask 7 is comprised of a plurality of cover pieces 21 spaced in adjacent relationship such that the picture 3 is substantially obscured or concealed from view by an observer (not shown) of the game 1. It is foreseen that the shape of the cover pieces 21 can be square, rectangular, triangular, hexagonal, diamond shaped, or any other shape or combination of shapes which, in an adjacent relationship in either a random or ordered array can similarly substantially conceal the picture 3 from an observer attempting to view the picture 3 through the viewing window 13.

Each of the cover pieces 21 has a pressure sensitive strip of adhesive 23 along one edge of a back side 24 thereof, similar to that marketed under the tradename Postit Notes. Alternatively, the adhesive 23 may be distributed substantially uniformly over the entire back side 24 of the cover pieces 21. The cover pieces 21 are individually removably secured by the adhesive 23 to an outer planar surface 25 of the viewing window 13 such that the portions of the picture 3 spaced behind the cover pieces 21 is substantially covered and concealed from view.

Each of the cover pieces 21 is clearly labelled with a mark 27 on an outer exposed surface 29 thereof which uniquely identifies each of the cover pieces 21 from each of the other cover pieces 21. The marks 27 may be randomly selected numbers, as shown in FIG. 1, with each successive use of the game 1 generally utilizing a different arrangement thereof. Alternatively, the marks 7 may be consecutive numbers, letters of the alphabet, a combination of alphanumeric characters, or any other indicia which appropriately provides unique identification. If such marks are arranged in a logical or sequential pattern, however, a random selection process is utilized to unpredictably expose piecemeal portions of the picture 3 therebeneath as hereinafter described.

In an actual application of the game 1, a picture 3 is selected and slidably inserted in the frame 9 as hereinbefore described. The viewing window 13 is then slidably inserted in the frame 9 in front of the picture 3. The cover pieces 21 are then removably secured by the pressure-sensitive adhesive 23 to the viewing window 13 in adjacent relationship such that all or substantially all features and details of the picture 3 are concealed from an observer attempting to view the picture 3 through the viewing window 13.

Each of the cover pieces 21 generally has the mark 27 applied to the exposed surface 29 thereof prior to securing the cover pieces 21 to the viewing window 13 where the cover pieces 21 are randomly spaced about the viewing window 13 to provide unpredictability. Alternatively, the marks 27 may be randomly applied to the cover pieces 21 after the cover pieces 21 have been secured to the viewing window 13.

When beginning an actual use of the game 1, the game 1 generally appears substantially as indicated in FIG. 1 such that the picture 3 is entirely concealed from view. Although the game 1 is shown with thirty-six of the cover pieces 21, it is to be understood that the actual number of cover pieces 21 can be substantially greater or lesser than that shown, depending on the desires of the operator directing the use of the game 1. The cover pieces 21 may be disposed horizontally and vertically as shown in FIG. 1, diagonally, in an ordered array, randomly, or in any other appropriate configuration. Further, the cover pieces 21 may all have the same size and shape, or may have an assortment of different sizes and shapes.

A procedure is established for sequentially selecting the marks 27 which determines the order of removal of the cover pieces 21. The details of the selection process are immaterial as long as randomness in removing the cover pieces 21 is maintained. The established procedure also includes designation of a proposed time delay imposed between the consecutive removal of the cover pieces 21.

For example, if the game is to be used as an icebreaker, such as for passengers who were photographed when they boarded a cruise ship, one of such snapshots could be selected, enlarged to facilitate ease of viewing and concealed with the cover pieces 21 as hereinbefore described. The snapshot could then be placed in a conspicuous location which would serve as a common meeting place to promote social intercourse among the passengers, such as at poolside, in the lounge, or other appropriate place. Then, the cover pieces 21 could be consecutively removed at desired time intervals, such as every fifteen minutes or the like. The time interval could be arbitrarily shortened or lengthened as desired as the game progresses, particularly if the removal of one of the cover pieces 21 fails to disclose any detail of the picture 3 thereunder.

Figure 2:
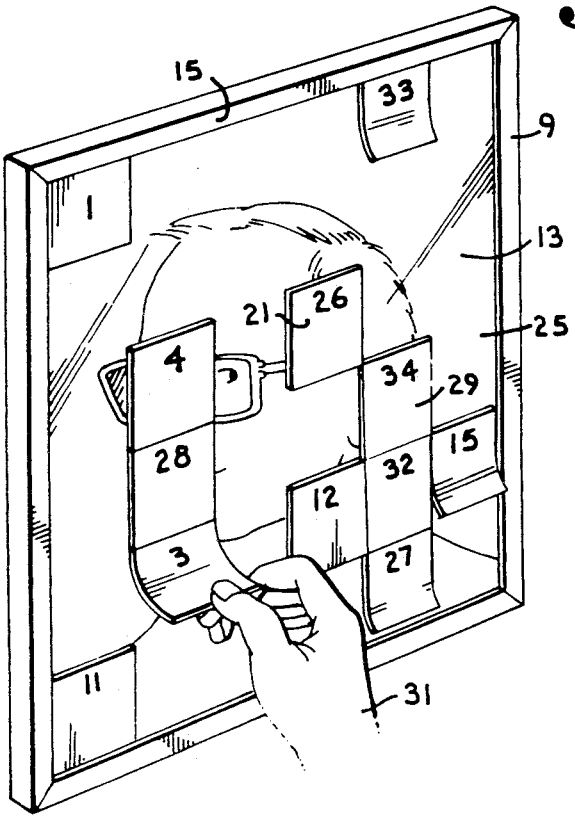
FIG. 2 is a perspective view of the picture identification game apparatus with a portion of the cover pieces removed.

FIG. 2 discloses a possible application of the game 1 wherein several of the cover pieces 21 have already been removed and the time delay between consecutive removal of the cover pieces 21 has expired such that it is time to remove another cover piece 21. Assume the selection process has indicated "3" as the identifying mark 27 on the cover piece 21 to be next removed. Then, a person 31, who has been assigned responsibility to remove the cover pieces 21 pursuant to the established procedure, peels off the cover piece 21 corresponding thereto, thereby exposing an additional portion of the underlying picture 3.

Figure 3:
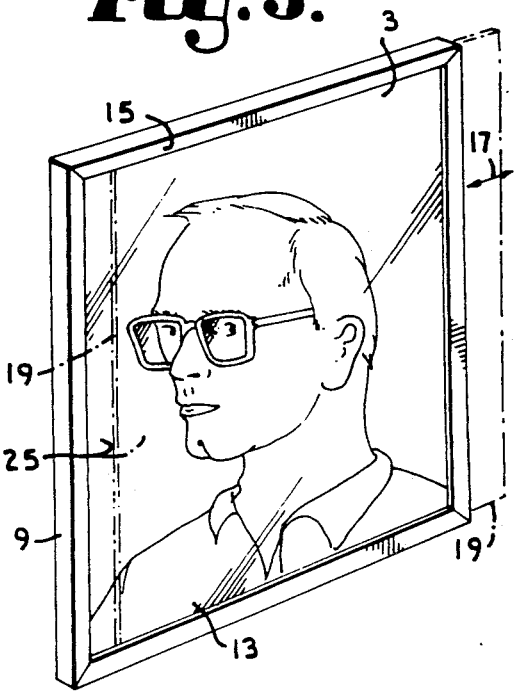
FIG. 3 is a reduced perspective view of the picture identification game apparatus with all of the cover pieces removed.

When enough of the cover pieces 21 have been removed whereby the subject matter of the picture 3 has been correctly identified, then the remaining cover pieces 21 may be removed revealing the entire picture 3, as shown in FIG. 3.

Alternatively, the game 1 could be published in a periodical, such as a daily newspaper, with the picture 3 entirely blanked out except for a small area corresponding to one removed cover piece 21. Then, when the next issue is published, an additional area of the picture 3, corresponding to a second removed cover piece 21, is revealed. The same procedure is continued in subsequent issues until a subscriber correctly identifies the identity of the subject matter of the partially exposed picture 3 in the publication.

As another alternative, the picture 3 could be dissected into a plurality of portions corresponding to the cover pieces 21. Each of such portions of the picture 3 could be coated on the reverse side with a pressure sensitive adhesive. Then, by a pre-determined process, such as by including one of such portions with each order at a fast-food restaurant, the portions are randomly distributed to game participants. Unique markings on each portion could identify the location where each portion is to be secured to a board for spacing the various portions in an adjacent relationship. This arrangement would correspond to the aforedescribed embodiment where the cover pieces 21 were sequentially removed, exposing additional details of the picture 3.

It is foreseen that the picture 3 could entail well-known trademarks, service marks, or other advertising or marketing indicia for promotional purposes which could beneficially utilize the use of the game 1.

It is to be understood that while certain forms of the present invention have been illustrated and described herein, it is not to be limited to the specific forms or arrangement of parts described and shown.

What is claimed and desired to be secured by Letters Patent is as follows:

1. A picture identification game apparatus comprising:

(a) a picture contained on a planar surface;

(b) a planar backing board;

(c) a planar, transparent viewing window;

(d) a frame having a lip adapted to contain said picture, said backing board, and said viewing window therein in overlying abutting relationship; said frame comprising a slot adapted for first inserting said picture into said frame and for then inserting said viewing window into said frame in front of said picture said viewing window having a first side facing toward said picture and a second side facing away from said picture; and (e) a plurality of opaque cover pieces for initially completely concealing said picture; each of said cover pieces having a pressure-sensitive adhesive strip along the edge of one side thereof; said cover pieces adhesively secured in side-by-side relationship to said second side of said viewing window; each of said cover pieces separately and individually peelingly removable from said viewing window such that a portion of said picture exposed by such removal of one of said cover pieces can be associated only with those portions of said picture exposed by previous removal of other ones of such cover pieces; each of said cover pieces uniquely identified by a mark on the side opposite the said side containing said adhesive strip.

2. The picture identification game apparatus according to claim 1 wherein each of said cover pieces is dimensioned such that not less than three of said cover pieces are required to span each lateral dimension of said picture concealed by said cover pieces.

3. The picture identification game apparatus according to claim 2 wherein said cover pieces are rectangularly shaped with sides thereof disposed horizontally and vertically.

4. The picture identification game apparatus according to claim 2 wherein said cover pieces are triangularly shaped.

5. The picture identification game apparatus according to claim 2 wherein said cover pieces are hexagonally shaped and are disposed in an ordered array.

* * * * *